US012078089B2

(12) United States Patent
Van Wingerden et al.

(10) Patent No.: US 12,078,089 B2
(45) Date of Patent: Sep. 3, 2024

(54) DEACTIVATING ROCKER ARM AND CAPSULES

(71) Applicant: Eaton Intelligent Power Limited, Dublin (IE)

(72) Inventors: Mark Van Wingerden, Battle Creek, MI (US); Andrei Radulescu, Marshall, MI (US); Matthew A. Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/474,007

(22) Filed: Sep. 25, 2023

(65) Prior Publication Data

US 2024/0011418 A1 Jan. 11, 2024

Related U.S. Application Data

(63) Continuation of application No. 17/606,419, filed as application No. PCT/EP2020/025189 on Apr. 24, 2020, now Pat. No. 11,867,097.

(60) Provisional application No. 62/839,236, filed on Apr. 26, 2019.

(51) Int. Cl.

| | |
|---|---|
| ***F01L 1/18*** | (2006.01) |
| ***F01L 13/00*** | (2006.01) |
| *F01L 1/46* | (2006.01) |
| *F01L 13/06* | (2006.01) |

(52) U.S. Cl.

CPC ..... *F01L 1/181* (2013.01); *F01L 13/0005* (2013.01); *F01L 2001/186* (2013.01); *F01L 2001/467* (2013.01); *F01L 2013/001* (2013.01); *F01L 13/065* (2013.01); *F01L 2820/031* (2013.01)

(58) Field of Classification Search

CPC ..... F01L 1/181; F01L 2001/186; F01L 2001/467; F01L 13/0005; F01L 13/06; F01L 13/065; F01L 2820/031

USPC ..... 123/90.39, 90.4, 90.44

See application file for complete search history.

(56) References Cited

U.S. PATENT DOCUMENTS 4,252,093 A * 2/1981 Hazelrigg ..... F01L 13/0005 123/90.32
4,556,025 A * 12/1985 Morita ..... F01L 1/181 123/90.27
4,726,332 A * 2/1988 Nishimura ..... F01L 1/267 123/90.39

(Continued)

FOREIGN PATENT DOCUMENTS

CN 204804892 U 11/2015
WO WO-2006090292 A2 * 8/2006 ..... F01L 1/18

OTHER PUBLICATIONS

CN Search Report for Chinese Application No. 2020800314587, 2 pages.

*Primary Examiner* — Jorge L Leon, Jr.
(74) *Attorney, Agent, or Firm* — Baker Botts L.L.P.

(57) ABSTRACT

A rocker arm including a cam side arm and a valve side arm is disclosed. The cam side arm can include a bearing surface, a cam-side pivot extension, and a plunger set seat. The valve side arm can include a rocker shaft bore configured to receive a rocker shaft, a valve-side pivot extension pivotally connected to the cam-side pivot extension, a capsule comprising a plunger set, and a capsule mount configured to receive the capsule. The capsule mount can include a lost motion spring.

19 Claims, 5 Drawing Sheets

(56) References Cited

U.S. PATENT DOCUMENTS

| | | | | |
|---|---|---|---|---|
| 2009/0228167 | A1* | 9/2009 | Waters | F01L 1/2422<br>701/115 |
| 2014/0182528 | A1* | 7/2014 | Jeon | F01L 1/181<br>123/90.12 |
| 2016/0281612 | A1* | 9/2016 | Toth | F01L 1/18 |
| 2017/0211431 | A1* | 7/2017 | Hashimoto | F01M 1/02 |
| 2017/0321575 | A1* | 11/2017 | Wetzel | F01L 1/185 |
| 2018/0371961 | A1* | 12/2018 | Bogdanski | F01L 1/181 |
| 2019/0309664 | A1* | 10/2019 | Batcheller | F01L 1/181 |

* cited by examiner

DEACTIVATING ROCKER ARM AND CAPSULES

PRIORITY

This application is a continuation under 35 U.S.C. § 120 of U.S. patent application Ser. No. 17/606,419, filed Oct. 25, 2021 and issued as U.S. Pat. No. 11,867,097 on 9 Jan. 2024, which claims the benefit under 35 U.S.C. § 371 of International Patent Application No. PCT/EP2020/025189, filed Apr. 24, 2020, which claims the benefit under 35 U.S.C. § 119(e) of U.S. Provisional Patent Application No. 62/839,236 filed Apr. 26, 2019, all of which are incorporated herein by reference.

FIELD

This application provides deactivating rocker arms and deactivating capsules.

BACKGROUND

It is desired to have rocker arms for cam-actuated valve-trains that can switch among functionalities. However, the desire for small size and packaging space creates challenges. Reliable actuation, connections between actuators and rocker arms, and packing for actuation are challenges.

SUMMARY

The devices, systems, and methods disclosed herein overcome the above disadvantages and improves the art by way of deactivating rocker arms, deactivation capsules, and methods for setting the lost motion length of the deactivating rocker arm. The deactivating capsules can be hydraulic capsules or electromagnetic capsules. The deactivating rocker arms can comprise the hydraulic capsules or the electromagnetic capsules, or the rocker arms can be configured for drop-in assembly of hydraulic or electromagnetic components. Light weighting, fast-acting, & low actuation force benefits can be achieved.

In one aspect, a hydraulic capsule can comprise a hollow capsule body comprising a latch groove and a hydraulic port in fluid communication with the latch groove. The hollow capsule body can set the location of a plunger, a latch set alignable with the latch groove, and a latch-setting insert. The latch set can be configured to reciprocate in the capsule body and switch between a latched condition and an unlatched condition. The latch-setting insert can be in the hollow capsule body, the latch-setting insert positioning the latch set with respect to the latch groove. The plunger can be configured to push the latch set towards the latch-setting insert. A lost motion spring can be incorporated into the hydraulic capsule, or the lost motion spring can be installed in capsule bore where the hydraulic capsule is mounted.

In another aspect, an electromagnetic capsule can be formed, or an electromagnetic latch system can be mounted in a capsule mount. The electromagnetic latch can comprise a solenoid-actuated pin and an actuatable plunger selectively latched and unlatched by the solenoid-actuated pin. A lost motion spring can be incorporated into the electromagnetic capsule or alternatively can be installed in the capsule mount. The lost motion spring is biased between the plunger and a cap or the end face, as appropriate. The solenoid-actuated pin can actuate along a pin axis that is perpendicular to a lost motion axis along which the plunger actuates.

Either the hydraulic capsule or the electromagnetic capsule can be installed in a capsule mount in a rocker arm to form a type III cam-actuated rocker arm. Alternatively, the valve side arm of the rocker arm can be configured for drop-in assembly of hydraulic or electromagnetic components to perform the desired latching and lost-motion functionalities.

A rocker arm formed according to these aspects can comprise the hydraulic capsule, electromagnetic capsule, or drop-in assembled components. A cam side arm can comprise a bearing surface, a cam-side pivot extension, and a plunger seat arranged in a triangular configuration. A valve side arm can comprise a rocker shaft bore for mounting to a rocker shaft, a valve side pivot extension pivotably connected to the cam side pivot extension, and a capsule mount comprising a capsule bore for seating the hydraulic or electromagnetic capsule or for receiving the drop-in components. The capsule bore can comprise an end face and a lost motion spring can be biased between the end face and the latch-setting insert. The rocker arm can comprise an arm extension extending from the rocker shaft, the arm configured to couple to a valve arrangement.

The rocker arm can be configured with the capsule mount inclined over the valve side pivot extension and the rocker shaft bore so that the capsule mount is not perpendicular over the bearing surface or the rocker shaft. Alternatively, a moment of inertia can be balanced so that valve actuation is fast and forces required for valve actuation are slow. Then, the capsule mount and seated hydraulic or electromagnetic capsule comprise a moment of inertia which is set over the rocker shaft. At a place above a center point of the rocker shaft, the moment of inertia is balanced.

It is desired to prevent twisting of the rocker arm against the rocker shaft or against the cam. So, there can be multiple force transfer axis such that the rocker arm is stepped or bent to counteract twisting at the cam. The capsule mount can comprise a centered longitudinal lost motion axis along which the plunger set can selectively act on the latch-setting insert and latch set to collapse the lost motion spring. The cam side arm can comprise a centered longitudinal force transfer axis along which the bearing surface is configured to transfer an actuation force to the plunger seat. The centered longitudinal lost motion axis can be offset from the centered longitudinal force transfer axis so that the plunger is configured to receive the actuation force transfer offset from the plunger seat. The valve arrangement can be further offset to counteract twisting at the cam. The arm extension can be shaped so that the valve arrangement is configured to receive the actuation force from the plunger askew from the centered lost motion axis.

Various methods for setting the lost motion length of the hydraulic capsule can be implemented, including select-sizing of the latch-setting insert or plunger. A product by process improvement can comprise machining an end of the hollow capsule to set the location of the latch set when the latch-setting insert adjoins the hollow capsule.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1:
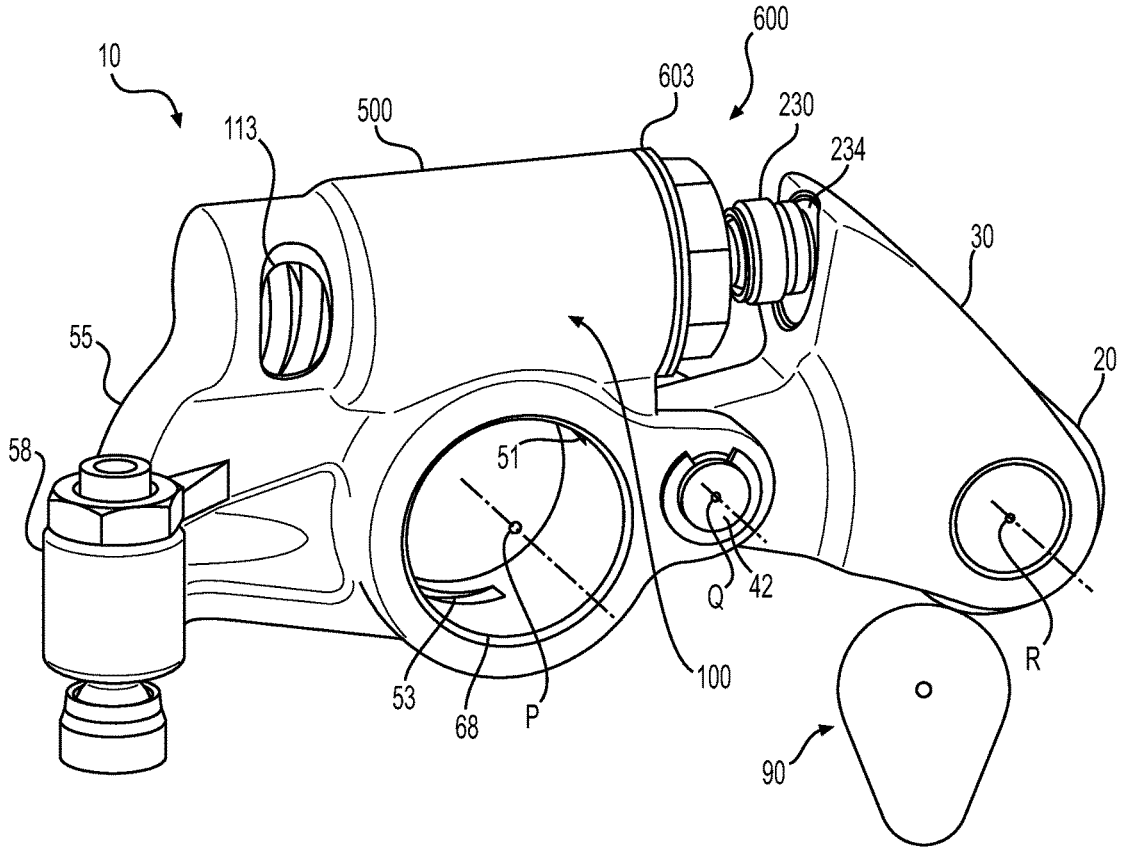
FIG. 1 is a view of a rocker arm.

Turning to FIGS. 1-4, alternative hydraulic capsules 600, 701 are shown in alternative type III rocker arms 10, 11. In FIG. 1, the capsule mount 100 for hydraulic capsule 600 is set over the rocker shaft bore 68 for the rocker shaft 60 so that a moment of inertia is over the rocker shaft during operation. Then, the weight of the hydraulic capsule 600 and capsule mount 100 does not weigh on the cam actuation 90 nor weigh on the valve assembly 910 or 920. The placement of the capsule 600 minimizes the effect of the effective mass of the deactivation features over the valves 911, 912 or 921, 922.

Figure 4:
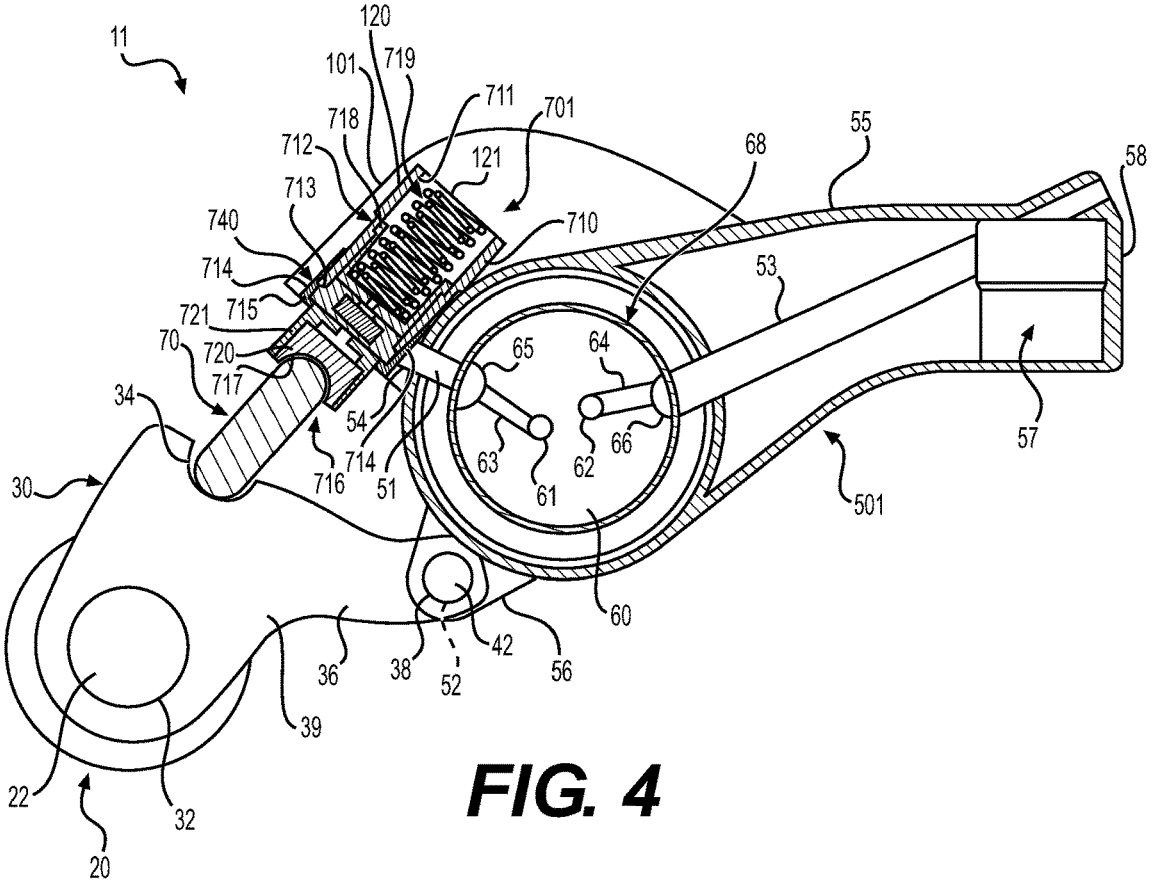
FIG. 4 is a view of alternative rocker arm and an alternative hydraulic capsule.

In FIG. 4, the hydraulic capsule 701 is inclined over the valve side pivot extension 56 and the rocker shaft bore 68, placing the moment of inertia askew to the rocker shaft 68 and aligned with forces from the cam actuation 90.

Impact of the moment of inertia can also be adjusted by using the pivot axis Q-Q external to the rocker shaft 68. This minimizes the moment of inertia when the capsules 600, 701, 702 are in the unlatched condition (deactivated, dynamic cylinder deactivation, cylinder deactivation mode) and reduces the packaging for the lost motion springs 80, 81, 719.

Figure 2:
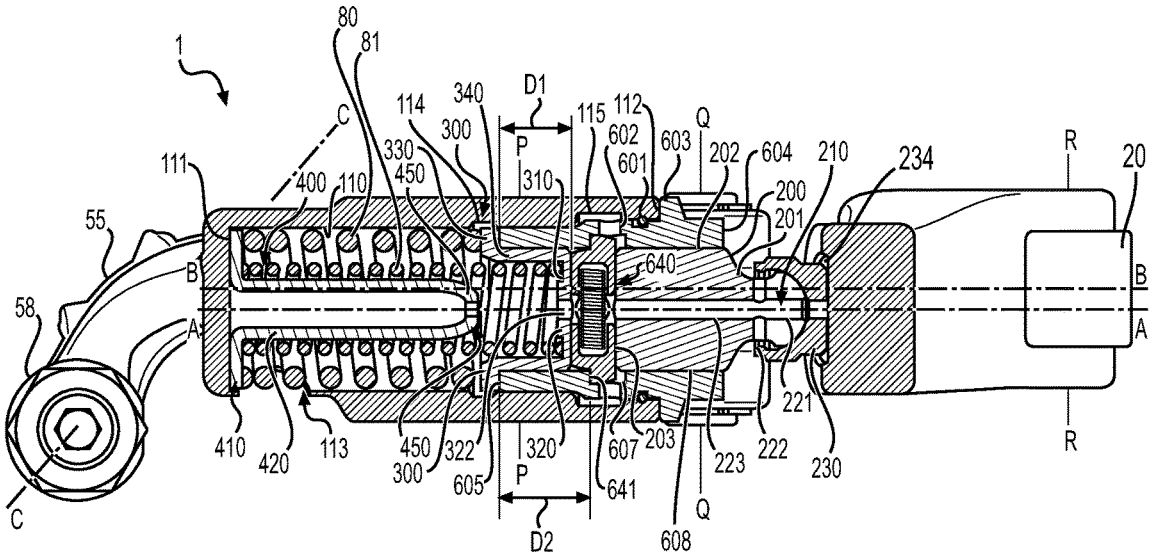
FIG. 2 is a cross-section view of the rocker arm.
Figure 3:
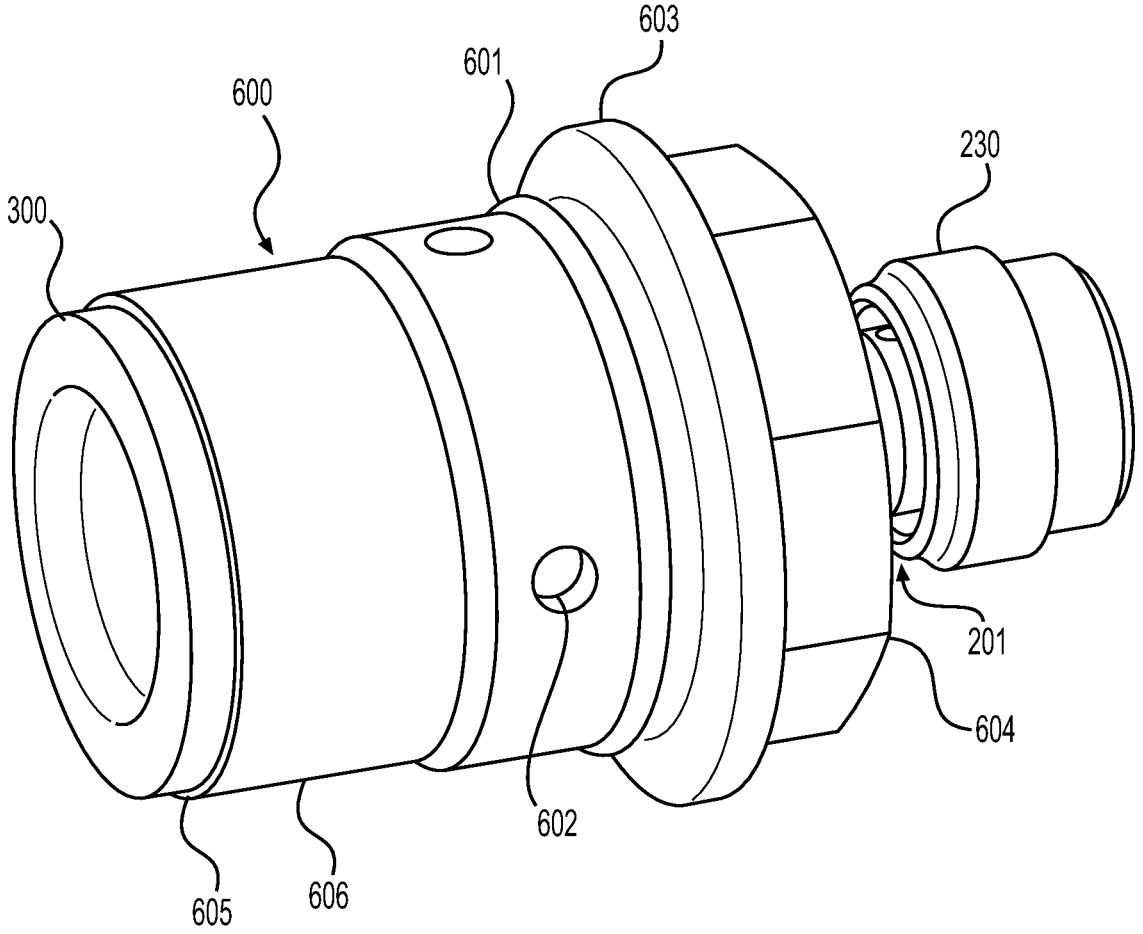
FIG. 3 is a view of a hydraulic capsule.

FIGS. 2 & 3 show that the hydraulic capsule 600 can comprise a hollow capsule body 606 comprising a latch groove 607 and a hydraulic port 602 in fluid communication with the latch groove 607. The hollow capsule body 606 can set the location of a plunger 200, a latch set 640 alignable with the latch groove 607, and a latch-setting insert 300.

The latch set 640 can be configured to reciprocate in the capsule body 606 and to switch between a latched condition and an unlatched condition. Deactivation of the rocker arm 10 can be enabled by a latching mechanism, the capsule 600, comprising two sliding bodies in the form of the latch-setting insert 300 and the plunger 200. One sliding body is connected to the valve side arm 500 and the second sliding body is connected to the cam side arm 30. These sliding bodies are coaxially located. While the latch set 640 is also coaxially located and translatable within the inner bore 608, the latch set 640 comprises latch pins that are actuatable perpendicular to the of 20 relative motion of the sliding bodies. Springs can be included in the latch set 640 to push latch pins outward to the latched condition. Latch ledges 641 on the latch pins can be pressed by the springs into the latch groove 607. In this latched condition, force from the cam actuation 90 can be passed through to the valve assembly 910, 920.

A selection assembly method or machining method or both can be used to set the latch ledges 641 with respect to the latch groove 607. Various methods for setting the latch of the hydraulic capsule can be implemented, including select-sizing of the latch-setting insert 300, 718 or plunger 200, 720, 726. A product by process improvement can comprise machining an end of the hollow capsule body 606 to set the location of the latch set when the latch-setting insert adjoins the hollow capsule. The hollow capsule body 606 can thereby further comprise a machined end 605 for adjoining a rim on the latch-setting insert 300. For another example, the insert end 605 can be machined, such as by grinding or cutting, to give the capsule body a custom ledge length D1 between the top of the latch set 640 and the insert end 605. This ledge length D1 can be matched to a cylinder length 340 of the latch-setting insert 300 to fix where in the latch groove 607 the latch ledge 641 abuts. Machining the capsule body 606 also impacts the lost motion set-length D2, which is how far the latch-setting insert 300 can press into the capsule body 606. Seating the latch-setting insert 300 in this way sets the lost motion length for the rocker arm assembly 10. A selection assembly method can be used alone or combined with the machining such that the size of the latch-setting insert 300 and alternatively or additionally the size of the plunger 200 is select-fit against the latch set 640 to place it in a desired location with respect to the latch groove 607.

To unlatch the latch set 640, hydraulic fluid can be pressurized to capsule hydraulic port 51 from rocker shaft 60. Directing the hydraulic fluid to an oil groove 115 in the valve side arm 500 supplies the hydraulic fluid to the hydraulic port 602 in the capsule body 606. The pressurized hydraulic fluid can overcome the spring force in the latch set 640 and collapse the latch ledges 641 out of engagement with the latch limit groove. When force from the cam actuation acts on the cam side arm 30, and when that force is transferred to the plunger 200, the latch set 640 and latch-setting insert 300 can slide in the capsule body and force the lost motion springs 80, 81 to collapse. A lost motion function can be achieved with no force from the cam actuation 90 reaching the valve assembly 910 or 920.

In the unlatched condition, the lost motion spring biases the cam side arm 30 away from the valve side arm 500. The lost motion springs 80, 81 maintain dynamic control of the cam side arm 30 as it pivots about the pivot axle 42. This enables the VVA assembly 1000 implementation discussed below whereby return springs 880 can be omitted over the resultant rocker arms 1010 & 2010. This dynamic control can be achieved in deactivation capsules 701 & 702 via the corresponding lost motion springs 719. Cam side arm 30 can pivot about pivot axle 42 in lost motion while the valve assemblies 910, 920 remain unactuated. The pivot axle 42 location, or location of pivot axis Q-Q, affects how much load goes on the lost motion springs 80, 81 during lost motion. In FIG. 2, we see that the pivot axis Q-Q aligns with a midline of the capsule 600 while the midline for the whole deactivation assembly, the capsule bore 110 plus capsule 600, is over the rotation axis P-P. This is a departure from having the pivot axis Q-Q aligned vertically or horizontally with the roller bearing axis R-R. In FIG. 1, the rotation axis P-P, pivot axis Q-Q, and roller bearing axis R-R are not coplanar, nor vertically nor horizontally aligned with each other. If roller bearing axis R-R and rotation axis P-P were horizontally aligned, then the pivot axis Q-Q would not be coplanar.

The plunger 200 can press on the latch set oppositely, and the location of the latch set 640 can be set with respect to the latch groove 607. The latch-setting insert 300 can be in the hollow capsule body 606, the latch-setting insert 300 positioning the latch set 640 with respect to the latch groove 607. The plunger 200 can be configured to push the latch set 640 towards the latch-setting insert 300.

One or more lost motion spring 80, 81 can be incorporated into the hydraulic capsule, or the lost motion springs 80, 81 can be installed in a capsule bore 110 of the capsule mount 100 where the hydraulic capsule 600 is mounted. The one or more lost motion springs 80, 81 can be arranged on a retainer 400. The retainer 400 or the springs 80, 81 can abut an end face 111 of the capsule bore 110 (with the springs 80, 81 abutting a base 410 of the retainer 400 when the retainer is included). A guide can extend from the base 410 to a nose 450 that functions as a travel stop. The latch-setting insert 300 cannot travel past the nose 450.

As shown, a pair of lost motion springs 80, 81 can function such that a first spring 81 abuts a base 310 of the latch-setting insert 300. A spring guide 320 can comprise a step portion or other neck to set the location of the first spring 81. A second spring 80 can abut a rim 330 of the latch-setting insert 300. The rim 330 can adjoin a groove 114 in the capsule bore 110. A vent 113 can be included through the capsule mount 100 so that the latch-setting insert 300 can move during lost motion without trapping air or other fluid in the capsule bore 110 and conversely no vacuum restricts the resetting of the hydraulic capsule 600.

The plunger 200 can be part of a plunger set seated by the hollow capsule bore 110. The plunger 200 can comprise a body 202 with an end surface 203 for pressing on the latch set 640. A neck down 201 can be included for light weighting and a spherical joint 210 can couple to an e-foot (also called an elephant foot) 230. Lubrication paths 221, 222, 223 can be included within the plunger body 202 to lubricate a ball-and-socket type joint between the spherical joint 210 and the e-foot 230. A port through the e-foot can lubricate the interface of the e-foot with the cam side arm 30 at a recess serving as an e-foot seat, also called a plunger set seat 234. Some rigidity is lost and flexibility is gained at the e-foot, which is beneficial at the junction of the cam side arm 30 and valve side arm 500. The lubrication path 223 can be fed from the hydraulic port 602 through the latch set 640. Hydraulic fluid from the hydraulic port 602 can also bleed off through pore 322 in base 310 of latch-setting insert 300.

Hydraulic capsule 600 can be designed as a drop-in insert. The valve side arm 500 can be configured with a capsule mount 100 comprising a capsule bore 110 with a bore opening 112. If the guide 410 is used, it can be dropped in the capsule bore 110 against the end face 111. The lost motion springs 80, 81 can be inserted. Then, with the capsule body 606, latch set 640, and latch-setting insert 300 already assembled, the hydraulic capsule 600 can be inserted with an o-ring or other seal 601 for abutting the capsule bore 110. A rim 603 on the exterior of the capsule body 606 can abut the bore opening 112. The plunger 200 can be pre-assembled with the hydraulic capsule 600 or drop-in assembled after the plunger body 606 is placed in the capsule bore 110. The plunger 200 can be inserted in the plunger end 604 of the capsule body 606 to reciprocate in the inner bore 608 of the capsule body 606.

In the alternative hydraulic capsule 701 in the rocker arm assembly 11 of FIG. 4, the lost motion springs 719 are within the capsule body 710 and a cap can optionally be used to hold the lost motion springs 719 in the capsule body 710 or the lost motion springs 719 can abut an end face 121 of the capsule bore 120. The capsule body 710 comprises an inner bore 711 with a step serving as an insert stop 712. The latch-setting insert 718 cannot press past the insert stop 712 when acted on by the lost motion springs 719, and the latch-setting insert 718 cannot travel more than enabled by the height of it (the rim will abut the end face 121 or cap to restrict lost motion). The latch-setting insert 718 cannot travel more than to the optional cap or end face of the capsule mount 101. The lost motion springs push the latch-setting insert 718 towards the latch set 740 and in opposition to the plunger 720. Alternative to a machined latch groove, a latch groove can be two-piece assembled. A latch stop 713 can be formed by a ledge or terminus on the inner bore 711 being spaced from a latch cup 715. The latch ledge of the latch set 740 can be biased by springs for the latched condition. Hydraulic fluid to capsule hydraulic port 51 and latch port 714 through latch cup 715 can collapse the latches of the latch set 740 so that the plunger 720 in a plunger case 721 can compress the lost motion springs 719.

Like hydraulic capsule 600, when the latch set 740 is in the latched condition, valve actuation can be achieved. Force can transfer from cam actuation 90 to cam side arm 30, through plunger set 716, through valve side arm 501 to valve assembly 910 or 920. But, when latch set 740 is collapsed by hydraulic pressure to capsule hydraulic port 51, and therefore in the unlatched condition, valve deactivation can be achieved. The hydraulic capsule 701 is functioning as a deactivation cartridge that enables techniques such as cylinder deactivation (CDA).

A hydraulic lash adjuster can be inserted in a second capsule bore 57 on the valve end 58 of the arm extension 55. Other variable valve actuation (VVA) techniques can be combined with the second capsule in second capsule bore 57 such as shifting from an early opening variable valve actuation technique (EEVO, EIVO) to a nominal valve opening or late valve opening (LEVO, LIVO). Closing techniques can also be shifted among, such as EEVC, EIVC, LEVC, & LIVC. As a primary variable valve actuation (VVA) objective, the second capsule can provide hydraulic lash adjustment while the hydraulic and electromechanical capsules 600, 701, 702 provide the function of an active fuel management (AFM) cartridge.

During the unlatched condition, cam actuation presses on the cam side arm 30, the plunger 720, in its optional case 721, pushes the latch set 740 into the capsule body 710 and the lost motion springs 719 are compressed. When a cam of cam actuation returns to base circle, the lost motion springs 719 push the latch set 740 back into position with the latch stop 713 and push the plunger 720 outwardly of, though still aligned with, the capsule body 710. A latch-setting insert 718 can be seated between the lost motion springs 719 and the latch set 740. Then, a travel stop 712 can be included in the bore 711 of the capsule body and a rim on the latch-setting insert 718 can be restricted by the travel stop 712. The travel stop 712 then prevents overtravel of latch set 740 which prevents pushing the plunger 720 out of the capsule body 710.

The plunger set 716 can be a multi-piece assembly. A push rod 70 can comprise a ball-type coupling at its ends as by having a rounded shape. The plunger 720 can comprise a socket-type coupling in push rod seat 717. Together, the plunger set 716 comprises a ball-and-socket type coupling yielding some loss of rigidity and some increase in flexibility in the coupling of forces from the cam side arm 30 to the valve side arm 501.

In another aspect, an electromagnetic capsule 702 can be formed, or an electromagnetic latch system can be mounted in capsule mount 102. Like the hydraulic capsules 600 & 701, the electromagnetic capsule 702 can be pre-assembled and installed in the valve side arm, or sets or subsets of parts of the electromagnetic capsule can be drop-in assembled to the capsule mount 102.

The electromagnetic latch pin actuator 733 can comprise a solenoid-actuated pin 731 and an actuatable plunger 726 selectively latched and unlatched by the solenoid-actuated pin 731. A lost motion spring 719 or pair of springs can be incorporated into the electromagnetic capsule 702 or alternatively can be installed in the capsule mount 102. The lost motion spring 719 is biased between an optional spring seat 729 on plunger 726 and a cap 723 or the end face 131 of the capsule bore 130 or against a base of a spring guide 724, as appropriate. The plunger 726 can comprise a rim for catching against a travel stop 722 in the inner bore 721 of the capsule body 720.

Figure 5:
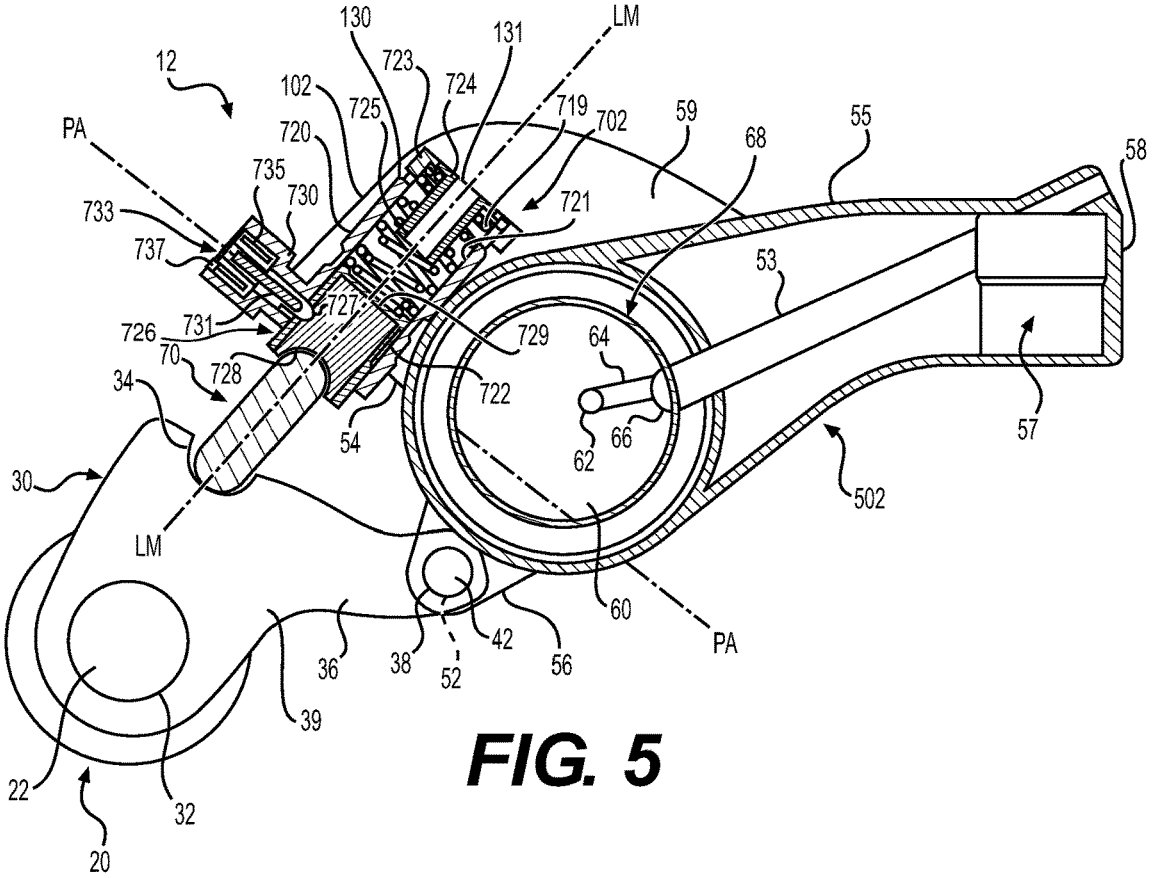
FIG. 5 is a view of an electromagnetic capsule in a rocker arm.

Several alternatives exist and can be substituted for the latch pin actuator 733 shown in FIG. 5. The latch pin actuator can be a bi-polar electromechanical latch or a single-pole (biased open or closed) electromechanical latch. A coil 735 on a bobbin 737 in a hub 730 can be electrified so that a current can pull the solenoid-actuated pin 731 out of the pin recess 727 to deactivate the rocker arm 12. With the plunger 726 free to move, force from the cam actuator on the cam arm 30 causes the plunger set to move such that the plunger 726 collapses the lost motion springs 719. The plunger can collapse so far as the lost motion travel stop 725 at the end of the spring guide 724. The spring guide 724 can be held in place by the capsule cap 723. When a cam of the cam actuator returns to base circle, the lost motion spring can return the plunger to abut the plunger stop 722. Whether the solenoid-actuated pin 731 is electrified to project back into the pin of 20 recess 727 or whether the solenoid-actuated pin 731 is biased by a spring, the plunger 726 can return to the latched condition. In the latched condition, the cam actuator can transfer actuation forces to the valve assembly 910 or 920. By incorporating a ball-and-socket type coupling between the plunger set seat 34, the push rod 70, and the plunger push rod seat 728, some rigidity is lost while flexibility is gained in the transfer of force in the varied axial directions. The push rod 70 can comprise two ball-type ends and the plunger set seat 34 and plunger push rod seat 728 can comprise socket-like recesses. Alternatives such as the above e-foot can be used. Or the push rod can be incorporated with the plunger 726, or the like.

The solenoid-actuated pin 731 can actuate along a pin axis PA-PA that is perpendicular to a lost motion axis LM-LM along which the plunger 726 actuates. The hub 730 can be installed on the valve side arm or it can be integrally formed with the valve side arm, with drop-in assembly of the latch pin actuator components. Or, the hub 730 can be integrated with the capsule body 720 so that a preconfigured electromagnetic capsule comprises all necessary components but perhaps the push rod 70 when the electromagnetic capsule 702 is installed in the valve side arm.

Figure 6A:
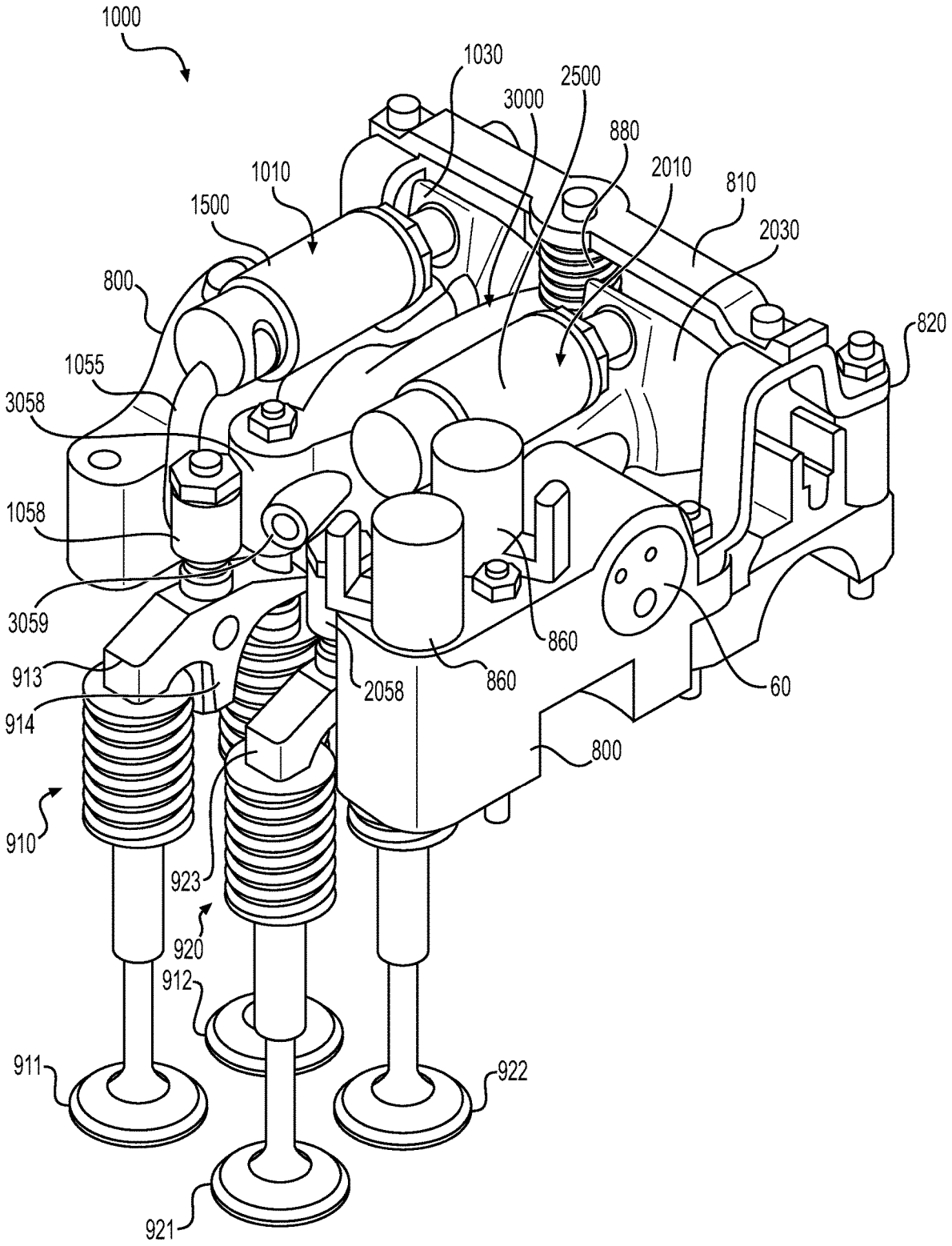
FIGS. 6A & 6B are views of a valve actuation assembly.
Figure 6B:
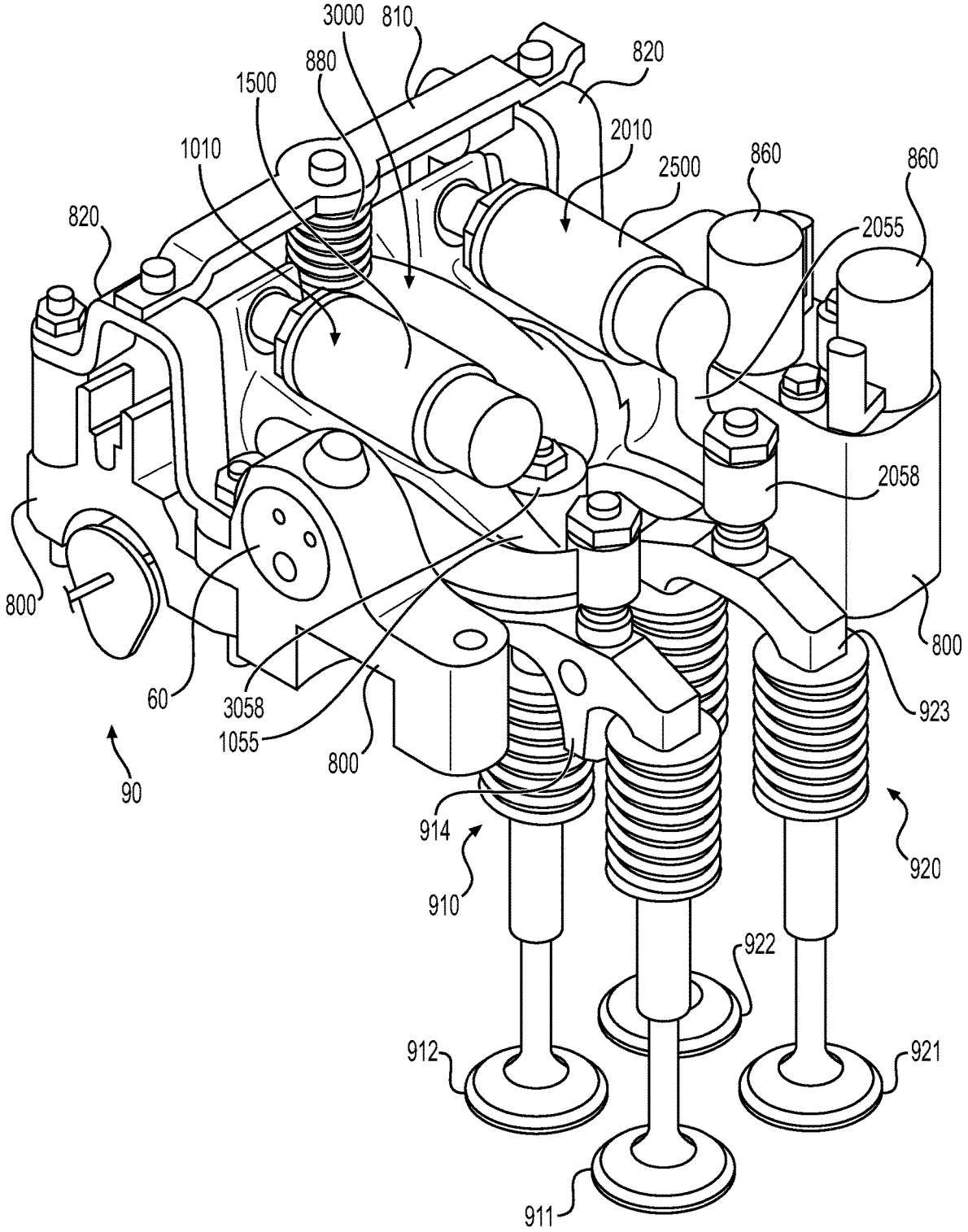

Either of the hydraulic capsules 600, 701 or the electromagnetic capsule 702 can be installed as cylinder deactivation capsules or cartridges in a capsule mount 100, 101, 102 in a rocker arm 10, 11, 12 to form a type III cam-actuated variable valve actuation assembly. One example of a type III cam-actuated variable valve actuation assembly 1000 is shown in FIGS. 6A & 6B.

A rocker arm formed according to these aspects can comprise the hydraulic capsule 600 or 701, electromagnetic capsule 702, or drop-in assembled components. The valve side arm 500, 501, 502 of the rocker arm 10, 11, 12 can be configured for drop-in assembly of hydraulic or electromagnetic components to perform the desired latching and lost-motion functionalities.

A cam side arm 30 can comprise a body 39 with several components arranged in a triangular configuration around the body 39. A bearing surface such as a tappet or roller 20 can receive actuation forces from a cam of a cam actuation such as an overhead cam rail system (OHC). A roller axle 22 can be installed in a roller axle bore of the cam side arm 30 to mount the roller 20. A cam-side pivot extension 36 can protrude with a pivot axle bore 38. A plunger set seat 34 for the plunger set with push rod or plunger set with e-foot can be receded into cam side arm body 39.

A valve side arm 500, 501, 502 can comprise a rocker shaft bore 68 for mounting to a rocker shaft 60. The rocker shaft 60 can comprise hydraulic feeds 61, 62, ports 63, 64, and glands 65, 66, as appropriate to supply hydraulic fluid to the hydraulic capsule 600, 701 or to supply hydraulic fluid to the second capsule in second capsule bore 57. The rocker shaft bore 68 can be through the valve side arm body 59 with a rotation axis P-P about which the rocker arm rotates when actuated. The rocker shaft 60 can rotate within the rocker shaft bore 68 according to fluid supply commands.

The body 59 can comprise the capsule mounts 100, 101, 102 with their moments of inertia balanced as detailed above. A valve side pivot extension 56 can be near an underside of the body 59, so that the pivot axle 42 connecting the cam side arm 30 to the valve side arm 500, 501, or 502 is beneath the rocker shaft. The valve side pivot extension 56 can be the component of the valve side arm 500, 501, or 502 nearest to the cam actuation 90 and bearing surface. A pivot axle bore 52 on the valve side arm can be pivotably connected by pivot axle 42 to the axle bore 38 on the cam side pivot extension 36. The valve side arm 500, 501, 502 can also comprise an arm extension 55 extending from the rocker shaft bore 68. The valve end 58 of the arm extension 55 can be configured to couple to a valve arrangement 910, 920 as by a second capsule in second capsule bore 57. Such second capsule can be a hydraulic lash adjuster (HLA) or other hydraulic device.

As above, the capsule mount 100, 101, 102 can comprise a capsule bore 110, 120, 130 for seating the hydraulic or electromagnetic capsule or for receiving the drop-in components. The capsule bore 110, 120, 130 can comprise an end face 111, 121, 131 and a lost motion spring 81, 719 can be biased between the end face and the latch-setting insert 300, 718 or plunger 726. The lost motion spring can be incorporated into the respective capsule, or the lost motion spring can be installed in the capsule bore where the respective capsule is mounted.

The rocker arm 10, 11, 12 can be configured with the capsule mount 101, 102, inclined over the valve side pivot extension 56 and the rocker shaft bore 68 so that the capsule mount is not perpendicular over the bearing surface or the rocker shaft. Alternatively, a moment of inertia can be balanced so that valve actuation is fast and forces required for valve actuation are slow. Then, the capsule mount 100 and seated hydraulic or electromagnetic capsule 600, 701, 702 comprise a moment of inertia which is set over the rocker shaft bore 68. At a place above a center point of the rocker shaft 60 or rocker shaft bore 68, such as at rotation axis P-P, the moment of inertia is balanced.

It is desired to prevent twisting of the rocker arm against the rocker shaft or against the cam of the cam actuation. There can be multiple force transfer axis such that the rocker arm is stepped or bent to counteract twisting at the cam and twisting at the rocker shaft bore 68. The capsule mount 100 can comprise a centered longitudinal lost motion axis A-A along which the plunger 200 of the plunger set can selectively act on the latch-setting insert 300, 718 and latch set 640, 740 or plunger 726 to collapse the lost motion spring 80, 81, 719. The cam side arm 30 can comprise a centered longitudinal force transfer axis B-B along which the bearing surface is configured to transfer an actuation force to the plunger set seat 34, 234. The centered longitudinal lost motion axis A-A can be offset from the centered longitudinal force transfer axis B-B so that the plunger 200, 726, 720 is configured to receive the actuation force transfer offset from the plunger set seat 34, 234. The offset prevents twisting. The valve arrangement 910, 920 can be further offset to counteract twisting at the cam and bearing surface interface and to counteract twisting at the rocker shaft bore 68. The arm extension 55 can be shaped so that the valve arrangement 910, 920 is configured to receive the actuation force from the plunger 200 askew from the centered longitudinal lost motion axis A-A, along an arm axis C-C. The pivot axis Q-Q, the roller bearing axis R-R, and rotation axis P-P can be parallel. However, the centered longitudinal lost motion axis A-A and centered longitudinal force transfer axis B-B are perpendicular to the pivot axis Q-Q, the roller bearing axis R-R, and rotation axis P-P. The centered longitudinal lost motion axis A-A is parallel to and not co-axial with centered longitudinal force transfer axis B-B. Arm axis C-C can be askew to each of the other axis P-P, Q-Q, R-R, A-A, & B-B. In some alternatives, arm axis C-C can be parallel to the centered longitudinal lost motion axis A-A and the centered longitudinal force transfer axis B-B. Arm axis C-C can be, in some alternatives, co-axial with the centered longitudinal lost motion axis A-A and the centered longitudinal force transfer axis B-B.

The rocker arms disclosed herein can be assembled into a variable valve actuation ("VVA") assembly 1000 such as shown in FIGS. 6A & 6B. It can be possible to mount a kit of rocker arms for individual cylinders of an engine, for sets of cylinders of the engine, or in kits configured for all cylinders of the engine. The design of the respective capsules 600, 701, 702 allows for individual rocker arm control for entering and exiting the latched and unlatched conditions (nominal operation and deactivated (CDA) operation). The size of the kit can determine the combination of VVA functions enabled. So, a kit of rocker arms for a single cylinder enables CDA mode control for that single cylinder. A kit of rocker arms for two or three cylinders enables CDA mode control for that set of cylinders. It is also possible to have individually controlled CDA or dynamic CDA by controlling each cylinder's rocker arms independent of other cylinder's rocker arms on a multi-cylinder engine. A scaleable flexibility in VVA functionality is enabled.

A carrier 800 is expeditious for the VVA assembly 1000. The carrier 800 can include receptacles for oil control valves (OCVs) 860 and ports and pathways can be drilled in the carrier 800 to direct oil from the OCVs 860 to the rocker shaft 60. The streamlined design of the hydraulic capsules 600, 701 enables a streamlined use of oil control valves. One oil control valve can control CDA mode for both intake and exhaust rocker arms 2010, 1010 in the kit selected. So, in VVA assembly 1000, one OCV controls CDA mode for both rocker arms and the other OCV controls the brake rocker arm.

If a kit of three VVA assemblies 1000 were assembled, then there would be three intake rocker arms 2010, three exhaust rocker arms 1010, and three braking rocker arms 3000. There could be two OCVs 860: one OCV for deactivating all intake and exhaust rocker arms 2010 & 1010 and the other OCV for switching in and out of engine braking on the three braking rocker arms 3000. If dynamic CDA were desired for individual control of each of the three cylinders affiliated with this kit, then there could be four OCVs: one OCV per each cylinder for deactivation control and the fourth OCV for switching in and out of engine braking on the three cylinders.

In the example, the exhaust rocker arm 1010 and intake rocker arm 2010 comprise rocker arms 10 of the type shown in FIG. 1. One benefit of the rocker arms 10, 11, 12 that is readily apparent is that return springs are not needed on them. While a reaction bar 810 and return spring 880 is shown for braking rocker arm 3000, such is not needed when using the rocker arms 10, 11, 12. If no braking were need, then bracketing 820, reaction bar 810 and return spring 880 could be omitted.

However, it is desired to have a VVA assembly 1000 where cylinder deactivation (CDA) and decompression exhaust braking (EB) can be performed, so braking rocker arm 3000 is included. A brake capsule 3058 can be installed with, for example, a castellation actuator 3059. Numerous alternatives exist in the art for the braking rocker arm 3000. Castellation actuator 3059 can comprise any such device owned by Applicant or equivalent thereof or alternative engine braking component.

A single exhaust rocker arm 1010 can be used to act on the exhaust valve assembly 910. The exhaust valve end 1058 of the exhaust valve side arm 1500 is configured to couple to an exhaust valve bridge 913. The exhaust valve bridge 913 can be associated with a bridge guide 914 and can be coupled to two exhaust valves. One of the exhaust valves is a braking exhaust valve 912, the other exhaust valve 911 operates according to the lift profile transferred from cam actuation 90. An e-foot connected to an HLA can seat on the exhaust valve bridge 913 to distribute valve actuation forces from the exhaust arm extension 1055 to both exhaust valves.

When engine braking is desired, the braking rocker arm 3000 can act on a guided pin passing through the exhaust valve bridge 913 and connect force to braking exhaust valve 912. Cam actuation can comprise a dedicated cam for the braking rocker arm 3000. The brake capsule 3058 can be selectively actuated to transfer force from the dedicated cam to the braking exhaust valve 912.

A single intake rocker arm 2010 can be used to act on two intake valves 921, 922 of intake valve assembly 920. An unguided valve bridge 923 can be used on the intake valve side because there are no secondary actuation arms like braking rocker arm 3000 is this example.

Cam actuation 90 can be mounted under carrier 800 to rotate a cam rail and thereby transfer actuation forces from respective cams to the cam side arms 1030, 2030. Valve side arms 1500, 2500 can receive those actuation forces if the capsules within, in this instance hydraulic capsules 600, are in the latched condition. If so the actuation forces transfer through the arm extensions 1055, 2055 to the valve ends 1058, 2058 and down to the valve assemblies 910, 920 as the timing on the cam actuation 90 dictates. However, if the unlatched condition is selected, then the valves 911, 912, 921, 922 can be deactivated for implementing a cylinder deactivation technique.

Other implementations will be apparent to those skilled in the art from consideration of the specification and practice of the examples disclosed herein.

What is claimed:

1. A rocker arm, comprising:

a cam side arm comprising:

a bearing surface, a cam-side pivot extension, and a plunger set seat arranged in a triangular configuration, the bearing surface configured to transfer an actuation force to the plunger set seat along a centered longitudinal force transfer axis; and a valve side arm comprising:

a rocker shaft bore configured to receive a rocker shaft;

a valve-side pivot extension pivotally connected to the cam-side pivot extension;

a capsule including a hollow capsule body comprising a plunger set configured to receive the actuation force from the plunger set seat; and a capsule mount configured to receive the capsule, the capsule mount comprising:

a lost motion spring; and a centered longitudinal lost motion axis along which the plunger set selectively acts so as to collapse the lost motion spring, wherein the centered longitudinal lost motion axis is offset from the centered longitudinal force transfer axis such that the plunger set receives the actuation force from the plunger set seat at an offset from the centered longitudinal lost motion axis, and wherein the plunger set seat engages the plunger set via a pivotal coupling.

2. The rocker arm of claim 1, wherein the valve side arm further comprises an arm extension extending from the rocker shaft bore along an arm extension axis, the arm extension configured to engage a valve arrangement, wherein the arm extension is shaped so as to convey the actuation force from the plunger set to the valve arrangement, and wherein the arm extension axis intersects the centered longitudinal lost motion axis at an oblique angle.

3. The rocker arm of claim 1, wherein the hollow capsule body further comprises a latch groove, and a port in communication with the latch groove.

4. The rocker arm of claim 3, wherein the capsule is a hydraulic capsule, and wherein the port is a hydraulic port in fluid communication with the latch groove.

5. The rocker arm of claim 3, wherein the hollow capsule body further comprises a latch set alignable with the latch groove, the latch set configured to reciprocate in the hollow capsule body and switch between a latched condition and an unlatched condition.

6. The rocker arm of claim 5, wherein the hollow capsule body further comprises a latch-setting insert configured to position the latch set with respect to the latch groove, the plunger set further configured to push the latch set towards the latch-setting insert.

7. The rocker arm of claim 6, wherein the capsule mount further comprises a capsule bore including an end face at an inner end of the capsule bore, and wherein the capsule mount is configured to receive the capsule via the capsule bore.

8. The rocker arm of claim 7, wherein the valve side arm further comprises a hydraulic port between the rocker shaft bore and the capsule bore.

9. The rocker arm of claim 7, wherein the capsule mount further comprises a spring guide including a travel stop configured to restrict travel of the latch-setting insert.

10. The rocker arm of claim 7, wherein the lost motion spring is biased between the end face and the latch-setting insert.

11. The rocker arm of claim 10, wherein the plunger set selectively acts on the latch-setting insert and the latch set so as to collapse the lost motion spring.

12. The rocker arm of claim 1, wherein the pivotal coupling comprises an e-foot coupled to a plunger.

13. The rocker arm of claim 12, wherein the plunger comprises one or more lubrication paths configured to lubricate the pivotal coupling.

14. The rocker arm of claim 1, wherein the capsule mount is inclined over the valve-side pivot extension and the rocker shaft bore.

15. A rocker arm, comprising:

a cam side arm comprising:

a bearing surface, a cam-side pivot extension, and a plunger set seat arranged in a triangular configuration, the bearing surface configured to transfer an actuation force to the plunger set seat along a centered longitudinal force transfer axis; and a valve side arm comprising:

a rocker shaft bore configured to receive a rocker shaft;

a valve-side pivot extension pivotally connected to the cam-side pivot extension;

an electromagnetic capsule including a hollow capsule body comprising a plunger set configured to receive the actuation force from the plunger set seat; and an electromagnetic latch comprising a solenoid-actuated pin configured to selectively switch between a latched condition and an unlatched condition;

a capsule mount configured to receive the electromagnetic capsule, the capsule mount comprising:

a lost motion spring; and a centered longitudinal lost motion axis along which the plunger set selectively acts so as to collapse the lost motion spring, wherein the centered longitudinal lost motion axis is offset from the centered longitudinal force transfer axis such that the plunger set receives the actuation force from the plunger set seat at an offset from the centered longitudinal lost motion axis, and wherein the plunger set seat engages the plunger set via a pivotal coupling.

16. The rocker arm of claim 1, wherein the pivotal coupling comprises a spherical coupling so as to facilitate a multi-axially flexible connection of the cam side arm to the valve side arm.

17. The rocker arm of claim 1, wherein the valve side arm further comprises a vent passage configured to permit a fluid venting and/or a fluid pressure equalization of the capsule.

18. The rocker arm of claim 1, wherein the lost motion spring comprises a first spring and a second spring coaxially arranged relative to the first spring.

19. The rocker arm of claim 18, further comprising a spring guide including an inner portion configured to guide the first spring, and an outer portion configured to guide the second spring.

* * * * *